United States Patent [19]

Skarsten

[11] Patent Number: 4,491,192

[45] Date of Patent: Jan. 1, 1985

[54] LADDER SAFETY DEVICE

[75] Inventor: Stephen R. Skarsten, Welwyn, England

[73] Assignee: Skilten Tools Limited, Welwyn, England

[21] Appl. No.: 545,371

[22] PCT Filed: Feb. 11, 1983

[86] PCT No.: PCT/GB83/00041

§ 371 Date: Oct. 12, 1983

§ 102(e) Date: Oct. 12, 1983

[87] PCT Pub. No.: WO83/02797

PCT Pub. Date: Aug. 18, 1983

[30] Foreign Application Priority Data

Feb. 12, 1982 [GB] United Kingdom ..... 8204119

[51] Int. Cl.[3] ..... E06C 7/48

[52] U.S. Cl. ..... 182/107; 182/214

[58] Field of Search ..... 182/107, 108, 214, 229; 248/210

[56] References Cited

U.S. PATENT DOCUMENTS

| | | | |
|---|---|---|---|
| 549,910 | 11/1895 | Endriss | 182/214 |
| 783,259 | 2/1905 | Friend | 182/214 |
| 2,103,603 | 10/1936 | Voigt | 182/120 |
| 2,327,317 | 8/1943 | Randall | 182/214 |
| 2,597,902 | 5/1952 | Roketa | 182/214 |
| 2,652,937 | 9/1953 | Cutler | 182/214 |
| 2,732,264 | 1/1956 | Smith | 182/214 |
| 3,318,416 | 5/1967 | Robinson | 182/214 |
| 3,419,109 | 7/1967 | Costlow et al. | 182/214 |
| 3,773,143 | 11/1973 | Del Prete et al. | 182/214 |
| 4,440,263 | 4/1984 | Smith | 182/214 |

FOREIGN PATENT DOCUMENTS

| | | | |
|---|---|---|---|
| 2012341 | 10/1978 | United Kingdom | 182/214 |

*Primary Examiner*—Reinaldo P. Machado

*Attorney, Agent, or Firm*—Birch, Stewart, Kolasch & Birch

[57] ABSTRACT

A ladder safety device is provided which may be fitted to a ladder and includes at least two elongated members cooperating telescopically. Apertures are formed in the elongated members which may be brought into register on telescopic extensions of the members to receive the ends of ladder uprights so that the device may be located transversely across the top of a ladder. The apertures may be of different sizes and may be brought into register at different relative locations of the elongated members to receive ladder uprights at different separations. In a preferred embodiment, the device comprises a central and two additional elongated members. The central member is formed with two spaced apertures and each additional member is formed with one aperture towards one end thereof.

5 Claims, 7 Drawing Figures

LADDER SAFETY DEVICE

This invention relates to ladder safety devices.

A variety of ladder safety devices have been produced which can be secured to the upper ends of ladder uprights to spread the load imposed by the ladder upon the wall or other vertical surface against which the ladder is rested, and to reduce the risk of the ladder sliding or tipping. Such devices are usually formed of the same materials as conventional ladders, that is to say aluminium or wood, and are bulky and inconvenient to store. They require to be screwed, clamped or otherwise secured to the ladder before each use and this is time-consuming.

It is an object of this invention to provide an improved ladder safety device which can be fitted to a ladder simply and quickly and which is lightweight and of low stored bulk.

Accordingly, the present invention consists in a ladder safety device having at least two elongate members cooperating telescopically, there being apertures formed in the members which can be brought into register on telescopic extension of the members to receive the ends of ladder uprights so that the device may be located transversely across the top of a ladder.

Preferably, the elongate members comprise respective coaxial tubes.

Advantageously, the apertures are of differing sizes and can be brought into register at different relative locations of the members to receive ladder uprights at different separations.

Suitably, the device comprises a central and two other elongate members, the central member being formed with two spaced apertures and each other member being formed with one aperture towards one end thereof.

Figure 1:
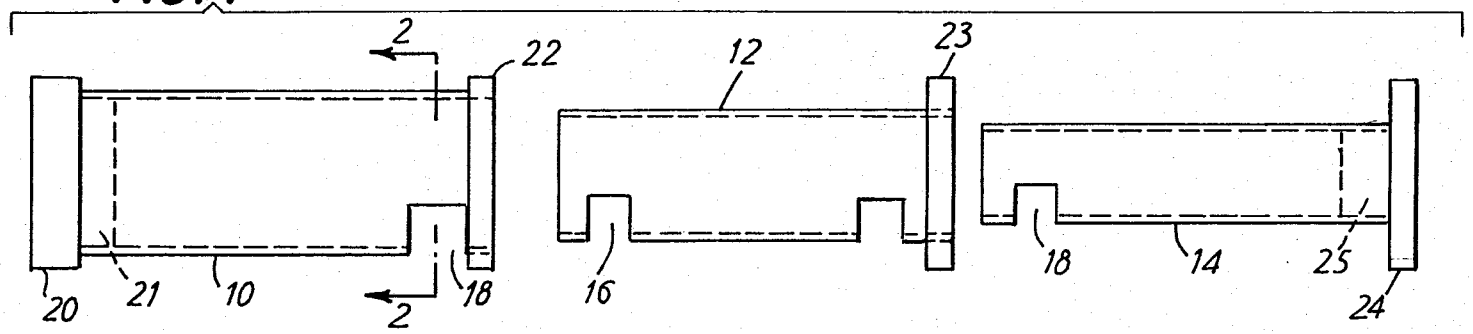
Figure 3:
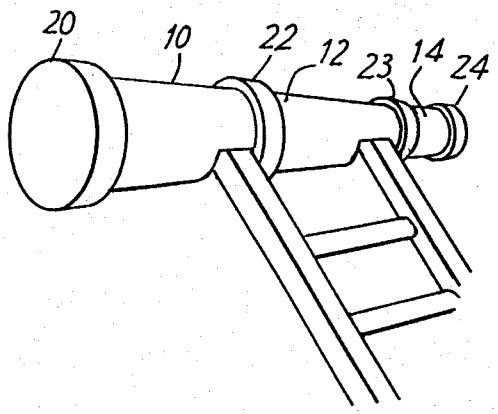
Figure 2:
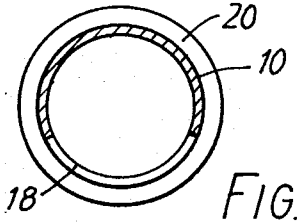
Figure 4:
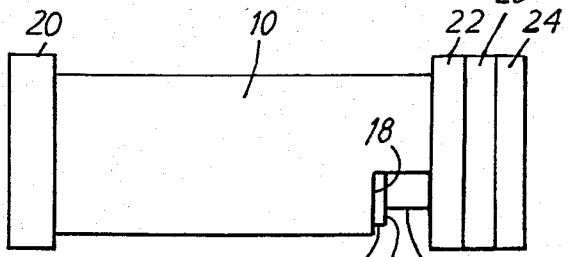
Figure 6:
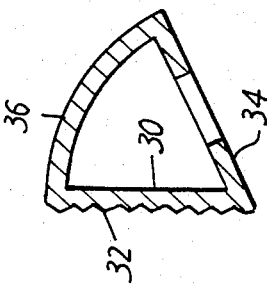
Figure 5A:
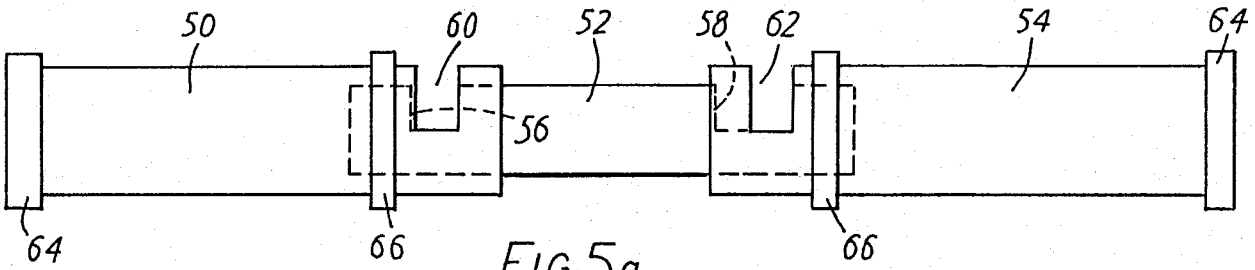

The invention will now be described by way of example with reference to the accompanying drawings in which:

FIG. 1 shows a ladder safety device according to this invention in which the constituent parts have been separated for clarity of illustration, FIG. 2 is a section of line 2—2 of FIG. 1, FIG. 3 is a perspective view to a different scale showing the device of FIG. 1 positioned on a ladder, FIG. 4 shows the device of FIG. 1 in a storage position, FIG. 5*a* and *b* show a further embodiment of this invention in two different orientations, and FIG. 6 is a cross section through part of yet a further embodiment of this invention.

Referring to FIGS. 1 and 2, the device can be seen to comprise outer, middle, and inner rigid plastics tubes shown at 10, 12 and 14 respectively. The inside and outside dimensions of these tubes are chosen so that the middle tube 12 is a sliding fit within the outer tube 10 and the inner tube 14 a sliding fit within the middle tube 12. The middle tube 12 is formed, toward each end, with a rectangular aperture 16. The separation between the two apertures 16 is selected to correspond with the separation of the uprights in the ladder with which the device is to be used. The width of the apertures is slightly greater than the width of the ladder uprights. The outer and inner tubes both have, at the respective end adjacent the middle tube, a similarly sized aperture 18.

At the end of the outer tube remote from the middle tube, there is provided an end cap 20 having an integral plug 21 which is a push fit in the end of the tube. At the opposite end of the outer tube there is provided a ring 22 having the same external diameter as the cap 21. A similar ring 23 is provided at the end of the middle tube remote from the outer tube and a cap 24 is mounted through plug 25 at the free end of the inner tube.

When the device is assembled, the ends of the free tubes are engaged so that they may telescope one into another. In the storage position, shown in FIG. 4, the tubes can be seen to be fully retracted with the inner and middle tubes being substantially wholly contained within the outer tube. Before using the device, the tubes are telescopically extended until each aperture 16 of the middle tube is in register with the corresponding aperture 18 in the inner or outer tube as the case may be. The device can then be located at the top of the ladder as shown in FIG. 3 with the ends of the ladder uprights being received by the aligned apertures. When the ladder—with the fitted safety device according to this invention—is rested against a wall the load is spread over the two end caps 20 and 24 and the rings 22 and 23. This spreading of the load effectively over the length of the safety device considerably reduces the risks of sliding or tipping. The engagement of the ladder uprights within the apertures 16 and 18 serves to lock the tubes in the extended position and to prevent relative movement between the tubes.

Referring now to FIGS. 5*a*and *b*, there is shown a second embodiment of this invention. The device again comprises three coaxial tubes of which an outer tube 50 and a middle tube 52 correspond with the outer and middle tubes of the previous embodiment. The inner tube of the previous embodiment, however, is replaced in this case by a second outer tube 54 which is of the same dimensions as the first outer tube 50. In the storage position of this embodiment, the middle tube 52 telescopes part-way into each of the two outer tubes until the opposing edges of the outer tubes are brought into contact.

Figure 5B:
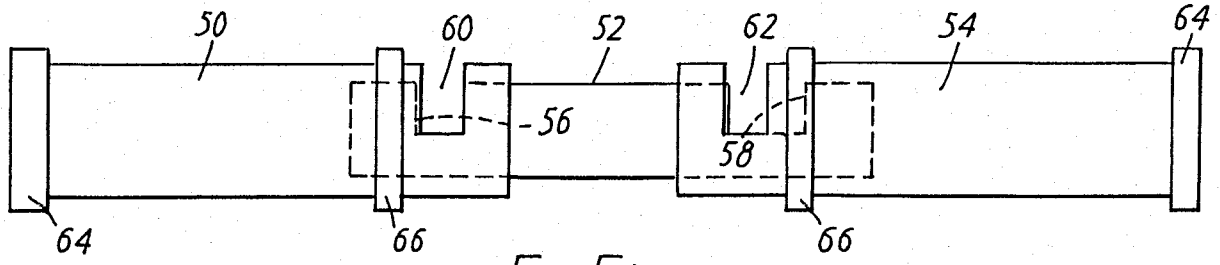

In a further departure from the first embodiment, the middle tube 52 is provided with two apertures 56 and 58 of differing width; a narrow aperture 56 of the same width as the apertures 60 and 62 in the two outer tubes and a broad aperture 58 of several times that width. It will be appreciated that whilst the aperture 60 in the first outer tube 50 can still only be brought into register with the narrower aperture 56 at one relative location of the tubes, there is a range of positions over which the aperture 62 in the second outer tube can be in register with the broader aperture 58. It will be appreciated that this gives rise to a range of possible separations between the aligned apertures 60 and 56 and the aperture 62, it being this separation that must accord with the separation of the ladder uprights. The position shown in FIG. 5*a* corresponds to the maximum separation of ladder uprights whilst in FIG. 5*b* the tubes have been telescoped together to the position of minimum ladder upright separation. Accordingly, this embodiment of the invention may be used with ladders having a range of upright separations, the permitted variation in the range corresponding to the amount by which the width of the broad aperture 58 exceeds that of the other apertures.

In addition to being provided with caps 64 at their free ends, each of the outer tubes also has a ring 66 disposed towards its inner end. When the device is in use, the end caps 64 and the two rings 66 provide four contact points with the wall or other vertical surface against which the ladder is inclined.

A further modification is illustrated at FIG. 6 which shows an alternative cross section for the tubes of the preceding embodiments. In this modification the tubes are not circular but comprise a plane, wall engaging portion 30. This portion has a ridged outer surface 32 to improve grip. Apertures as previously described are provided in a further wall portion 34, the circumference being completed by arcuate wall portion 36.

It must be appreciated that this invention has been described by way of examples only and a wide variety of modifications are possible without departing from the scope of the invention. Thus, for example, the device could be provided with two instead of three telescoping members and those members could take forms other than the described coaxial tubes.

I claim:

1. A ladder safety device having at least two elongate members cooperating telescopically, there being apertures formed in the members which can be brought into register on telescopic extension of the members to receive the ends of ladder uprights, so that the device may be located transversely across the top of a ladder.

2. A device according to claim 1, wherein the elongate members comprise respective coaxial tubes.

3. A device according to claim 1, comprising one central and two other elongate members, the central member being formed with two spaced apertures and each other member being formed with one aperture towards one end thereof.

4. A device according to claim 1, wherein the apertures are of differing sizes and can be brought into register at different relative locations of the members to receive ladder uprights at different separations.

5. A device according to claim 1, further comprising wall engaging means provided on the members.

* * * * *